US005772840A

United States Patent [19]

Morinaga

[11] Patent Number: 5,772,840

[45] Date of Patent: Jun. 30, 1998

[54] TAPE APPLICATOR FOR APPLYING A TRANSFERRING MATERIAL TO A SHEET

[75] Inventor: Hideyoshi Morinaga, Hirakata, Japan

[73] Assignee: Union Chemicar Co., Ltd., Hirakata, Japan

[21] Appl. No.: 578,021

[22] Filed: Dec. 26, 1995

[30] Foreign Application Priority Data

Dec. 26, 1994 [JP] Japan ..... 6-337774

[51] Int. Cl.[6] ..... B32B 31/00

[52] U.S. Cl. ..... 156/540; 156/577

[58] Field of Search ..... 156/540, 577, 156/579, 523

[56] References Cited

U.S. PATENT DOCUMENTS 4,718,971 1/1988 Summers ..... 156/540

5,346,580 9/1994 Elges et al. ..... 156/540

5,393,368 2/1995 Stevens ..... 156/540 X 5,490,898 2/1996 Koyama ..... 156/540

*Primary Examiner*—James Engel

*Attorney, Agent, or Firm*—Dennison, Meserole, Pollack & Scheiner

[57] ABSTRACT

A casing has an opening at an end thereof, a supply spool and a take-up spool are rotatably mounted in the casing. A pressure blade member is provided in a longitudinal direction of the casing. The pressure blade member has a pressure blade portion projected from the opening, and a shaft portion rotatably supported in the casing so as to be rotated about an axis thereof. A coil spring is mounted on the shaft portion so as to resiliently hold the pressure blade member. A tape is wound on the supply spool and on the take-up spool, and slidably attached on the pressure blade portion.

6 Claims, 3 Drawing Sheets

TAPE APPLICATOR FOR APPLYING A TRANSFERRING MATERIAL TO A SHEET

BACKGROUND OF THE INVENTION

The present invention relates to a tape applicator for applying a transferring material such as a correcting agent layer coated on a base tape to a material such as a sheet of paper with pressure.

Recently, a tape applicator is becoming commercialized. In the applicator, a base tape such as a paper tape or plastic tape having a layer releasing characteristic is coated with correcting agent or adhesive to form a correcting agent layer or an adhesive layer. The tape is wound on a supply spool in the applicator and an end of the tape is wound on a take-up spool. A part of the tape between the supply spool and the take-up spool is exposed from an opening of the applicator, slidably mounted on a tape guide blade secured to the applicator.

In operation, the applicator is grasped by a hand, and the tape on the guide blade is pressed against paper sheet. The applicator is moved in a desired direction, while the correcting agent layer or adhesive layer on the underside of the base tape is released from the tape and applied to the paper sheet. The base tape from which the layer has been removed is taken up on the take-up spool.

The applicator is liable to be tilted during operation in a lateral direction with respect to the moving direction. If the applicator tilts, the tape on the blade is not entirely engaged with the paper sheet in the whole width thereof. In such a state, a side portion of the tape is raised to form a gap between the layer on the tape and the paper sheet. Accordingly, it may happen that a part of the correcting agent layer is not applied to the paper sheet or that the agent layer is loosely applied to the paper sheet, forming cracks in the agent layer applied on the paper sheet. Namely, the correcting agent is not sufficiently applied to a desired position of the paper sheet.

SUMMARY OF THE INVENTION

An object of the present invention is to provide a tape applicator which may eliminate the above described disadvantages of the conventional device.

According to the present invention, there is provided a tape applicator comprising a casing having an opening at an end thereof, a supply spool rotatably mounted in the casing, a take-up spool rotatably mounted in the casing, a pressure blade member provided in the casing and arranged in a longitudinal direction of the casing, the pressure blade member having a pressure blade portion projected from the opening, and a shaft portion rotatably supported in the casing so as to be rotated about an axis thereof.

Resilient means is provided for resiliently holding the pressure blade member so that the pressure blade portion is arranged in a direction perpendicular to moving direction of the tape applicator when used.

A base tape, on the outside surface of which a transfer agent layer is provided, is wound on the supply spool and on the take-up spool, and slidably arranged around the tip edge of the pressure blade portion.

In an aspect of the invention, the resilient means is a coil spring.

These and other objects and features of the present invention will become more apparent from the following detailed description with reference to the accompanying drawings.

DETAILED DESCRIPTION OF THE PREFERRED EMBODIMENT

Figure 1:
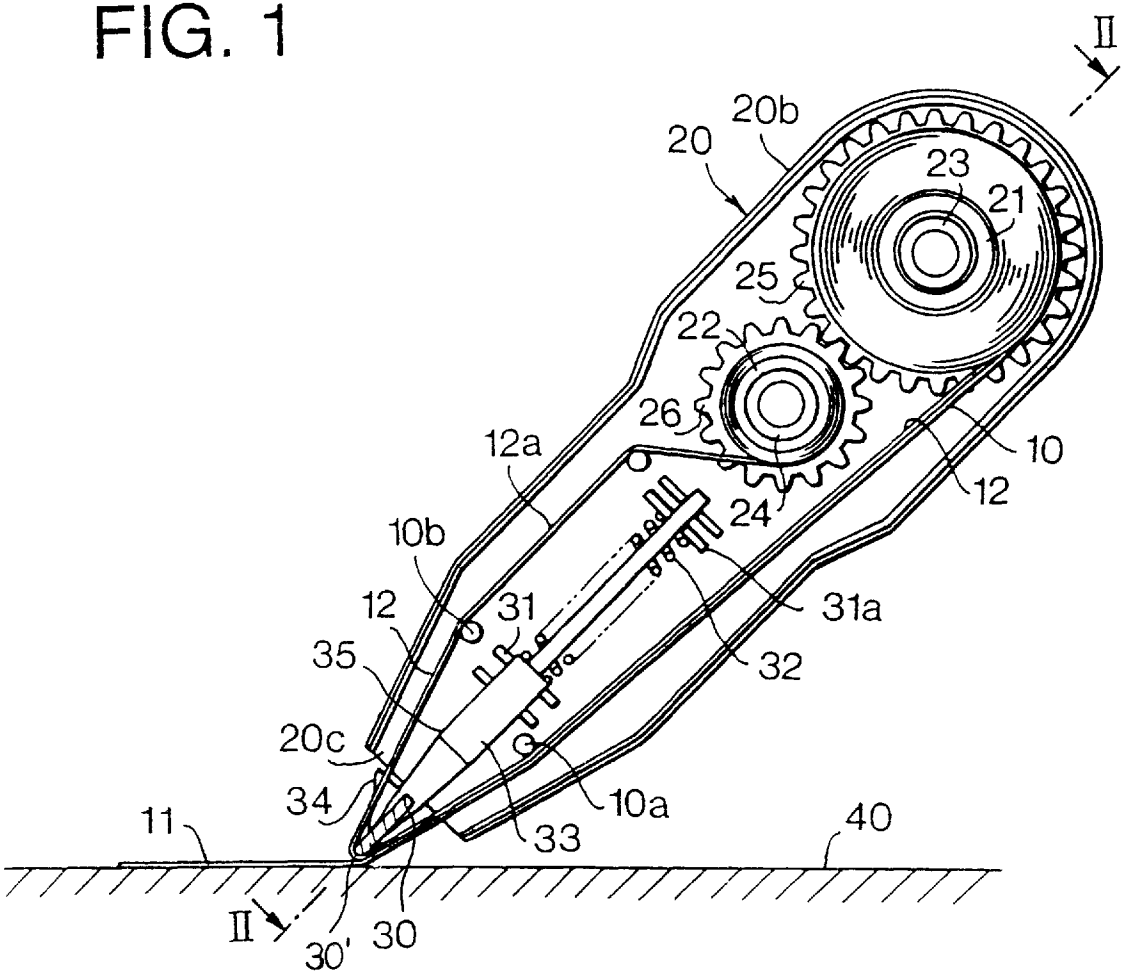
FIG. 1 is a sectional plan view of a tape applicator of the present invention.
Figure 2:
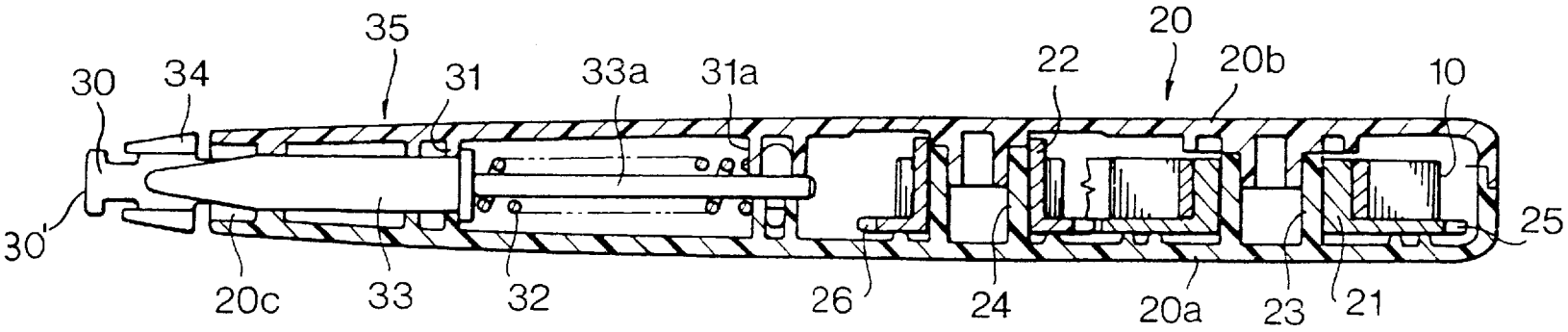
FIG. 2 is a sectional side view of the applicator taken along a line II—II of FIG. 1.

Referring to FIGS. 1 and 2, a tape applicator of the present invention comprises a casing 20 having a left side case 20*a* and a right side case 20*b*. An opening 20*c* is formed in an end portion of the casing 20. A supply spool 21 is rotatably mounted on a boss 23 formed in the left side case 20*a*. The supply spool 21 has a gear 25 secured to a left portion thereof. A correction tape 10 is wound on the supply spool 21. The correction tape 10 comprises a base tape 12 made of plastic and a correction white agent layer 11 coated on the outer surface of the base tape 12. A take-up spool 22 is rotatably mounted on a boss 24 formed in the left side case 20*a* at a position corresponding to the supply spool 21. The take-up spool 22 has a gear 26 secured to a left side portion thereof and engaged with the gear 25 of the supply spool 21.

A pressure blade member 35 is provided in the casing 20 adjacent to the opening 20*c*, and arranged in the longitudinal direction of the casing. The pressure blade member 35 comprises a pressure blade portion 30 projected from the opening 20*c*, a cylindrical base portion 33, and a shaft portion 33*a* which are integral with each other. The base portion 33 and the shaft portion 33*a* are rotatably mounted by bearing members 31 formed in the casing 20 so as to be rotated about the axis thereof. A pair of guide plates 34 are formed on opposite sides of the blade portion 30. A coil spring 32 is provided between the cylindrical base portion 33 and the bearing member 31*a* , so that the blade portion 30 is resiliently held at a neutral position shown in FIGS. 1 and 2, at which the tip edge 30' of the blade portion 30 is perpendicular to the moving direction of the applicator.

As shown in FIG. 1, an end of the correction tape 10 wound on the supply spool 21 is drawn from the spool and connected to the take-up spool 22 passing around the blade portion 30 which is, guided by tape guides 10*a* and 10*b*. The guide plates 34 are provided on each side of the blade portion 30, so that the tape 10 is exactly positioned around the edge of the blade portion.

Describing the correcting operation, the casing 20 is grasped by a hand to engage the correction tape 10 on the blade portion 30 with a paper sheet 40 at a desired position. Then, the blade portion 30 is pressed against the paper sheet 40 and the casing 20 is moved in the right direction of FIG. 1. The correction white agent layer 11 on the tape 10 is applied to the paper sheet so that the desired position is erased by the white agent. If the applicator is lifted from the paper sheet 40, the white agent is left on the sheet.

When the correction agent layer 11 is applied to the paper sheet 40, the tape 10 is forcibly drawn from the supply spool 21 to continuously supply the tape to the blade portion 30, so that the supply spool 21 is rotated. Since the gear 25 of the spool 21 is engaged with the gear 26 of the take-up spool 22, the spool 22 is rotated with the rotation of the spool 21. Thus, a remaining tape portion 12*a* without the correction agent 11 is wound on the take-up spool 22. The spool 22 has a slip mechanism (not shown) for absorbing the difference between peripheral speeds of the tape windings on the spools 21 and 22.

Figure 4:
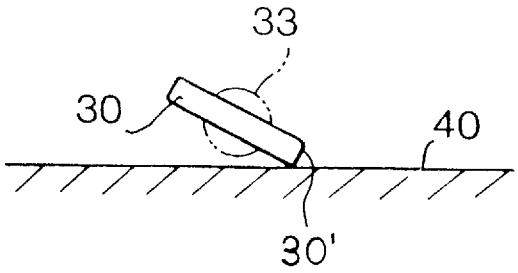
FIG. 4 is a schematic front view for explaining the operation of the tape applicator.

In the present invention, the pressure blade member 35 is rotatably supported in bearing members 31 and 31*a* . If the casing 20 is laterally tilted by the hand during the correcting operation, the blade portion 30 is rotated about axis of the cylindrical base portion 33. For example, as shown in FIG. 4, a left side edge of the blade portion 30 is pressed against the paper sheet 40, the reactive force causes the blade portion to rotate in the counterclockwise direction about the axis of the base portion 33. Thus, the blade portion 30 becomes horizontal, so that the correction agent layer 11 on the tape 10 is entirely adhered on the paper sheet 40.

Figure 3:
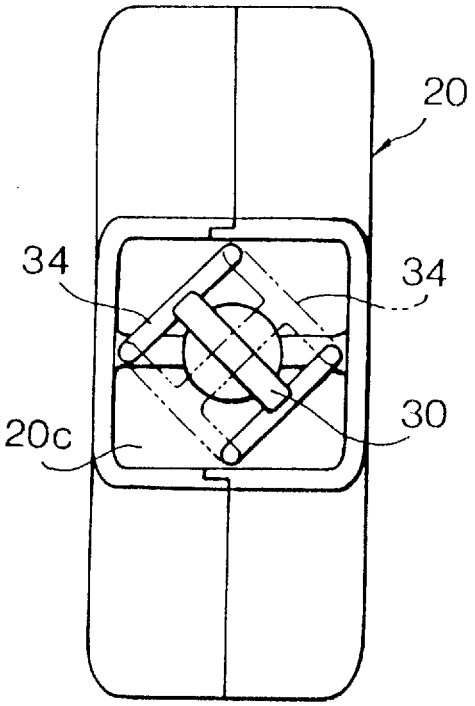
FIG. 3 is an enlarged front view explanatorily showing an operation of the applicator.

The elastic force of the spring 32 is set such that the pressure blade member 35 can be rotated about 45 degrees in the clockwise and counterclockwise directions as shown in FIG. 3. If the blade portion 30 is rotated in excess of 90 degrees, the tape is excessively twisted, which may cause the break of the tape. By the restriction of the rotation, the tape is prevented from breaking. Since no gap is provided between the tape and the paper sheet, the correction agent layer can be entirely transferred to the paper sheet.

After the correction, when the blade portion 30 is disengaged from the paper sheet 40, the blade portion is returned to the original position by the elastic force of the coil spring 32.

In the above described embodiment, although the blade portion 30 is returned to the neutral position by the coil spring, it is possible to provide another means. For example, if an inner end of the shaft portion 33*a* is secured to the bearing member 31*a* , the blade portion can be returned to the neutral position by the elastic force of the twisted shaft portion.

In accordance with the present invention, the pressure blade member is rotatably held in the casing to be rotated about the axis thereof. Thereafter, even if the casing is tilted, the tape on the blade portion is entirely engaged with the paper sheet. Thus, the correction agent layer is sufficiently applied to a desired position of the paper sheet.

While the invention has been described in conjunction with preferred specific embodiment thereof, it will be understood that this description is intended to illustrate and not limit the scope of the invention, which is defined by the following claims.

What is claimed is:

1. A tape applicator comprising:

a casing having an opening at an end thereof;

a supply spool rotatably mounted in the casing;

a take-up spool rotatably mounted in the casing;

a pressure blade member provided in the casing and arranged in a longitudinal direction of the casing;

the pressure blade member having a pressure blade portion projected from the opening, and a shaft portion rotatably supported in the casing so as to be rotated about an axis thereof so that when the casing is laterally tilted with respect to the moving direction, the pressure blade member is rotated by reaction to an applied force, causing the tip edge thereof to coincide with a surface of paper to be applied with the transfer agent layer;

resilient means for resiliently holding the pressure blade member so that a tip edge of the pressure blade portion is yieldably held in a direction perpendicular to moving direction of the tape applicator when force against a paper is applied; and a base tape, on the outside surface of which a transfer agent layer is provided, wound on the supply spool and on the take-up spool, and slidably attached on the tip edge of the pressure blade portion.

2. The tape applicator according to claim 1 wherein the resilient means is provided for allowing the pressure blade member to rotate about 45 degrees.

3. The tape applicator according to claim 1 wherein the supply spool has a gear which is engaged with a gear of the take-up spool in order to rotate the take-up spool.

4. The tape applicator according to claim 3 wherein slip means is provided for absorbing a difference between peripheral speeds of windings of the supply spool and the take-up spool.

5. A tape applicator comprising:

a casing having an opening at an end thereof;

a supply spool rotatably mounted in the casing;

a take-up spool rotatably mounted in the casing;

a pressure blade member provided in the casing and arranged in a longitudinal direction of the casing;

the pressure blade member having a pressure blade portion including a tip edge projected from the opening, and a shaft portion supported in the casing so as to permit rotation about an axis thereof so that when the casing is laterally tilted with respect to a moving direction, the pressure blade member is rotated so that the tip edge thereof coincides with a paper surface to which the transfer agent is to be applied;

a base tape, on the outside surface of which a transfer agent layer is provided, said base tape with transfer agent being wound on the supply spool and an end of the base tape being wound on the take-up spool, said base tape being slidably arranged around the tip edge of the pressure blade portion; and means for resiliently holding the pressure blade member so that the tip edge of the pressure blade portion is positioned by the force reactive to pressure in a direction perpendicular to the direction of the tape applicator movement.

6. A tape applicator comprising:

a casing having an opening at an end thereof;

a supply spool rotatably mounted in the casing;

a take-up spool rotatably mounted in the casing;

a pressure blade member provided in the casing and arranged in a longitudinal direction of the casing;

the pressure blade member having a pressure blade portion projected from the opening, and a shaft portion rotatably supported in the casing so as to be rotated about an axis thereof;

a coil spring for resiliently holding the pressure blade member so that a tip edge of the pressure blade portion is yieldably held in a direction perpendicular to moving direction of the tape applicator when used; and a base tape, on the outside surface of which a transfer agent layer is provided, wound on the supply spool and on the take-up spool, and slidably attached on the pressure blade portion, whereby when the casing is laterally tilted with respect to the moving direction, the pressure blade member is rotated so that the tip edge thereof coincides with a surface of paper to be applied with the transfer agent layer.

* * * * *